US008950776B2

(12) United States Patent
Tsukada et al.

(10) Patent No.: US 8,950,776 B2
(45) Date of Patent: Feb. 10, 2015

(54) WHEELCHAIR AND BED

(75) Inventors: Shohei Tsukada, Osaka (JP); Yohei Kume, Osaka (JP); Hideo Kawakami, Osaka (JP); Tohru Nakamura, Osaka (JP); Toshihide Ueda, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 13/498,692

(22) PCT Filed: Jun. 20, 2011

(86) PCT No.: PCT/JP2011/003502

§ 371 (c)(1),
(2), (4) Date: Mar. 28, 2012

(87) PCT Pub. No.: WO2011/161930

PCT Pub. Date: Dec. 29, 2011

(65) Prior Publication Data

US 2012/0181779 A1 Jul. 19, 2012

(30) Foreign Application Priority Data

Jun. 21, 2010 (JP) ..... 2010-140087

(51) Int. Cl.
*A61G 7/16* (2006.01)
*A61G 5/00* (2006.01)
*A61G 5/10* (2006.01)

(52) U.S. Cl.
CPC *A61G 5/006* (2013.01); *A61G 7/16* (2013.01); *A61G 2005/1089* (2013.01); *A61G 2007/165* (2013.01)
USPC ..... 280/648; 280/30; 5/86.1

(58) Field of Classification Search
CPC ..... A61G 1/017; A61G 5/00; A61G 5/006; A61G 7/10; A61G 7/015; A61G 7/16; A61G 2007/165; A61G 5/1067; B60S 9/00; B60S 9/14; B60S 9/22; B62D 61/12
USPC ..... 280/647, 648, 30, 643, 47.12, 5.32, 280/47.16; 5/86.1, 47.2, 47.21
See application file for complete search history.

(56) References Cited

U.S. PATENT DOCUMENTS 3,138,805 A * 6/1964 Piazza ..... 5/618
3,618,968 A * 11/1971 Greer ..... 280/47.11

(Continued)

FOREIGN PATENT DOCUMENTS

CN 101352391 A 1/2009
CN 201356724 Y 12/2009

(Continued)

OTHER PUBLICATIONS

International Preliminary Report on Patentability issued Jan. 15, 2013 in International (PCT) Application No. PCT/JP2011/003502.

(Continued)

*Primary Examiner* — J. Allen Shriver, II
*Assistant Examiner* — Steve Clemmons
(74) *Attorney, Agent, or Firm* — Wenderoth, Lind, & Ponack, L.L.P.

(57) ABSTRACT

In a bed including a wheelchair and a bed main body portion, the wheelchair has a seating bottom portion composed of bendably coupling a plurality of divided members. A chair bottom support member supports the seating bottom portion, the chair bottom support member changing a shape of a leg bottom part in conjunction with inclination of a back bottom part. A chair base portion fixes the chair bottom support member. Front casters are provided in the chair base portion, the front casters being capable of freely changing direction. Both side wheel bottom support members are axially supported on the chair base portion. Rear casters are provided at one end of the both side wheel bottom support members, the rear casters being capable of freely changing direction. Traveling wheels are provided at the other end of both side wheel bottom support members, whose traveling direction is fixed to a straight-moving direction. Caster links couple parts of the both side wheel bottom support members on the side of the rear casters and the back bottom part of the chair bottom support member.

10 Claims, 7 Drawing Sheets

(56) References Cited

U.S. PATENT DOCUMENTS

| | | | | | |
|---|---|---|---|---|---|
| 3,936,893 | A * | 2/1976 | Anderson et al. | 5/86.1 |
| 4,245,847 | A * | 1/1981 | Knott | 280/5.2 |
| 4,997,200 | A * | 3/1991 | Earls | 280/648 |
| 5,050,899 | A * | 9/1991 | Stensby | 280/250.1 |
| 5,137,295 | A | 8/1992 | Peek | |
| 5,860,664 | A * | 1/1999 | Smith | 280/250.1 |
| 5,964,473 | A * | 10/1999 | Degonda et al. | 280/250.1 |
| 6,135,222 | A * | 10/2000 | Furukawa | 180/65.51 |
| 6,155,583 | A * | 12/2000 | Koike | 280/250.1 |
| 6,454,286 | B1 * | 9/2002 | Hosino | 280/250.1 |
| 7,306,251 | B2 * | 12/2007 | Bright et al. | 280/304.1 |
| 7,419,182 | B2 * | 9/2008 | Goertzen et al. | 280/647 |
| 2006/0082117 | A1 * | 4/2006 | Turturiello et al. | 280/755 |
| 2006/0191073 | A1 * | 8/2006 | Honda | 5/600 |
| 2009/0091092 | A1 * | 4/2009 | Molnar | 280/5.28 |
| 2009/0160158 | A1 * | 6/2009 | Yao | 280/287 |
| 2010/0052270 | A1 * | 3/2010 | Ivanchenco | 280/5.28 |

FOREIGN PATENT DOCUMENTS

| | | | | |
|---|---|---|---|---|
| JP | 10118122 | A * | 5/1998 | A61G 1/02 |
| JP | 2941930 | | 8/1999 | |
| JP | 2002-78746 | | 3/2002 | |
| JP | 2002-238953 | | 8/2002 | |
| JP | 2005-34626 | | 2/2005 | |
| JP | 2006-181105 | | 7/2006 | |
| JP | 2008-131961 | | 6/2008 | |
| JP | 2008-178700 | | 8/2008 | |

OTHER PUBLICATIONS

International Search Report issued Aug. 16, 2011 in International (PCT) Application No. PCT/JP2011/003502.

Japanese Office Action (OA) issued Apr. 16, 2013 in Japanese Patent Application No. JP 2012-521315.

First Office Action issued Feb. 28, 2014 in corresponding Chinese Application No. 201180004069.6 (with English translation).

* cited by examiner

WHEELCHAIR AND BED

TECHNICAL FIELD

The present invention relates to a wheelchair and a bed in which a part thereof can be separated as a wheelchair.

BACKGROUND ART

Upon nursing care of a bedridden aged person or an ailing person (hereinafter, collectively abbreviated as the care-receiver), a transferring task between a wheelchair and a bed is a heavy burden on a caregiver. In order to reduce the burden on the caregiver, there is a combination bed in which a part of the bed is separated so as to be transformed into a wheelchair.

Such a combination bed is composed of combining a bed main body portion and a wheelchair in a flat posture. In order to combine the wheelchair with the bed main body portion, there is a need for laterally placing the wheelchair in the flat posture alongside the bed main body portion without any gap inbetween. For a purpose of laterally placing the wheelchair alongside the bed main body portion without any gap inbetween, a wheelchair capable of laterally moving is proposed (for example, refer to Patent Literature 1).

FIGS. 6A and 6B are side views of a conventional wheelchair 1. FIG. 6A is a side view of the wheelchair 1 at the time of normal use, and FIG. 6B is a side view of the wheelchair 1 at the time of omnidirectional movement. The wheelchair 1 has casters 2 on the front side (on the left side in FIGS. 6A and 6B), has traveling wheels 3 in the center, and has casters 4 on the rear side (on the right side in FIGS. 6A and 6B). Although the directions of the casters 2, 4 can be changed to an arbitrary direction, the direction of the traveling wheels 3 cannot be changed. As shown in FIG. 6A, in the case where the care-receiver is moved by this wheelchair 1 at a time of normal use, the casters 2 and the traveling wheels 3 are grounded. At the time, the casters 4 are not grounded but slightly floated up from the ground. When the wheelchair 1 travels with the combination of the casters 2 and the traveling wheels 3, due to the fixed traveling direction of the traveling wheels 3, the wheelchair can stably travel without shifting in the left and right directions. As shown in FIG. 6B, in this wheelchair 1, when a movable frame operating handle 5 is pulled up, the casters 4 are grounded, so that the traveling wheels 3 are floated up. When the traveling wheels 3 are floated up by manually moving the movable frame operating handle 5, the wheelchair is supported only by the casters 2, 4 so as to be movable in a direction (the lateral direction) perpendicular to the traveling direction. Thereby, the wheelchair 1 can be laterally placed alongside the bed main body portion.

CITATION LIST

Patent Literature

[Patent Literature 1] Japanese Unexamined Patent Publication No. 2006-181105

SUMMARY OF THE INVENTION

Technical Problem

However, the conventional wheelchair 1 is only assumed to be changed to a flat posture after being laterally moved as the wheelchair. That is, with the conventional wheelchair 1 is only assumed to be laterally moved in a wheelchair state. Therefore, with a configuration of the conventional wheelchair 1, the gravity center balance is favorable in the wheelchair state. However, there is a possibility that the gravity center balance is deteriorated in the flat posture.

In order to enable the conventional wheelchair 1 to laterally move in the wheelchair state, there is a need for manually operating the movable frame operating handle 5 in the wheelchair state so as to allow the casters 4 to be grounded. Therefore, in the wheelchair state, the casters 4 are grounded on the rear side of a waist, so that a turning radius of the wheelchair 1 is increased. When the turning radius of the wheelchair 1 is increased, for example, in a narrow interior space, there is a case where an operability of the wheelchair 1 is deteriorated.

Furthermore, the conventional wheelchair 1 only has a function as a wheelchair.

In the conventional wheelchair 1, at the time of laterally moving the wheelchair 1 for combination, there is a problem in that operation of the movable frame operating handle 5 takes time and efforts.

Therefore, an object of the present invention is to provide a bed to be combined with a wheelchair and a wheelchair in which the operability is favorable in the wheelchair state (in a seating state), and the wheels can be switched with less time and effort.

Solution to the Problem

In order to achieve the above object, the present invention is configured as below.

According to one aspect of the present invention, there is provided a wheelchair, comprising:

a seating bottom portion composed of a back bottom part, a seating bottom part, and a leg bottom part which are bendable relative to each other;

a chair bottom support member composed of a chair back bottom support member supporting the back bottom part and a chair leg bottom support member supporting the leg bottom part;

a link member for actuating the chair leg bottom support member in conjunction with an action of the chair back bottom support member;

a chair base portion coupled to the chair bottom support member;

front wheels serving as freewheels provided in a front part of the chair base portion;

wheel bottom support members whose intermediate parts are axially supported on a rear part of the chair base portion;

rear wheels serving as freewheels provided at one end of the wheel bottom support members;

traveling wheels serving as fixed wheels provided at the other end of the wheel bottom support members; and wheel links coupling rear wheel sides of the wheel bottom support members and the chair back bottom support member.

In a case where the seating bottom portion is in a seating posture, lower surfaces of the traveling wheels are positioned on a lower side of a plane composed of lower surfaces of the rear wheels and lower surfaces of the front wheels, and in a case where the seating bottom portion is in a flat posture, the lower surfaces of the traveling wheels are positioned on an upper side of the plane composed of the lower surfaces of the rear wheels and the lower surfaces of the front wheels.

According to another aspect of the present invention, there is provided a wheelchair, comprising:

a seating bottom portion composed of a back bottom part, a seating bottom part, and a leg bottom part which are bendable relative to each other;

a chair bottom support member composed of a chair back bottom support member supporting the back bottom part and a chair leg bottom support member supporting the leg bottom part;

a link member that actuates the chair leg bottom support member in conjunction with an action of the chair back bottom support member;

a chair base portion coupled to the chair bottom support member;

front wheels serving as freewheels provided in a front part of the chair base portion;

rear wheel bottom support members whose ends are axially supported on a rear part of the chair base portion;

a rear wheel serving as a freewheel provided at one end of the rear wheel bottom support member;

traveling wheels serving as fixed wheels provided on a rear side of the chair base portion; and wheel links coupling rear wheel sides of the rear wheel bottom support members and the back bottom part of the chair bottom support member.

In a case where the seating bottom portion is in a seating posture, lower surfaces of the traveling wheels are positioned on a lower side of a plane composed of lower surfaces of the rear wheels and lower surfaces of the front wheels, and in a case where the seating bottom portion is in a flat posture, the lower surfaces of the traveling wheels are positioned on an upper side of the plane composed of the lower surfaces of the rear wheels and the lower surfaces of the front wheels.

According to still another aspect of the present invention, there is provided a bed, comprising:

the wheelchair according to the above aspect; and a bed main body portion with which the wheelchair is separably combined.

Advantageous Effects of the Invention

With such a configuration, in the bed to be combined with the wheelchair and the wheelchair of the present invention, the gravity center balance is stabilized in the flat posture, operability is favorable in the wheelchair state (in the seating state), and the wheels can be switched with less time and effort.

BRIEF DESCRIPTION OF THE DRAWINGS

These and other objects and features of the present invention will be elucidated from the following description relating to embodiments regarding the attached drawings. In the drawings.

DESCRIPTION OF THE EMBODIMENTS

Figure 1:
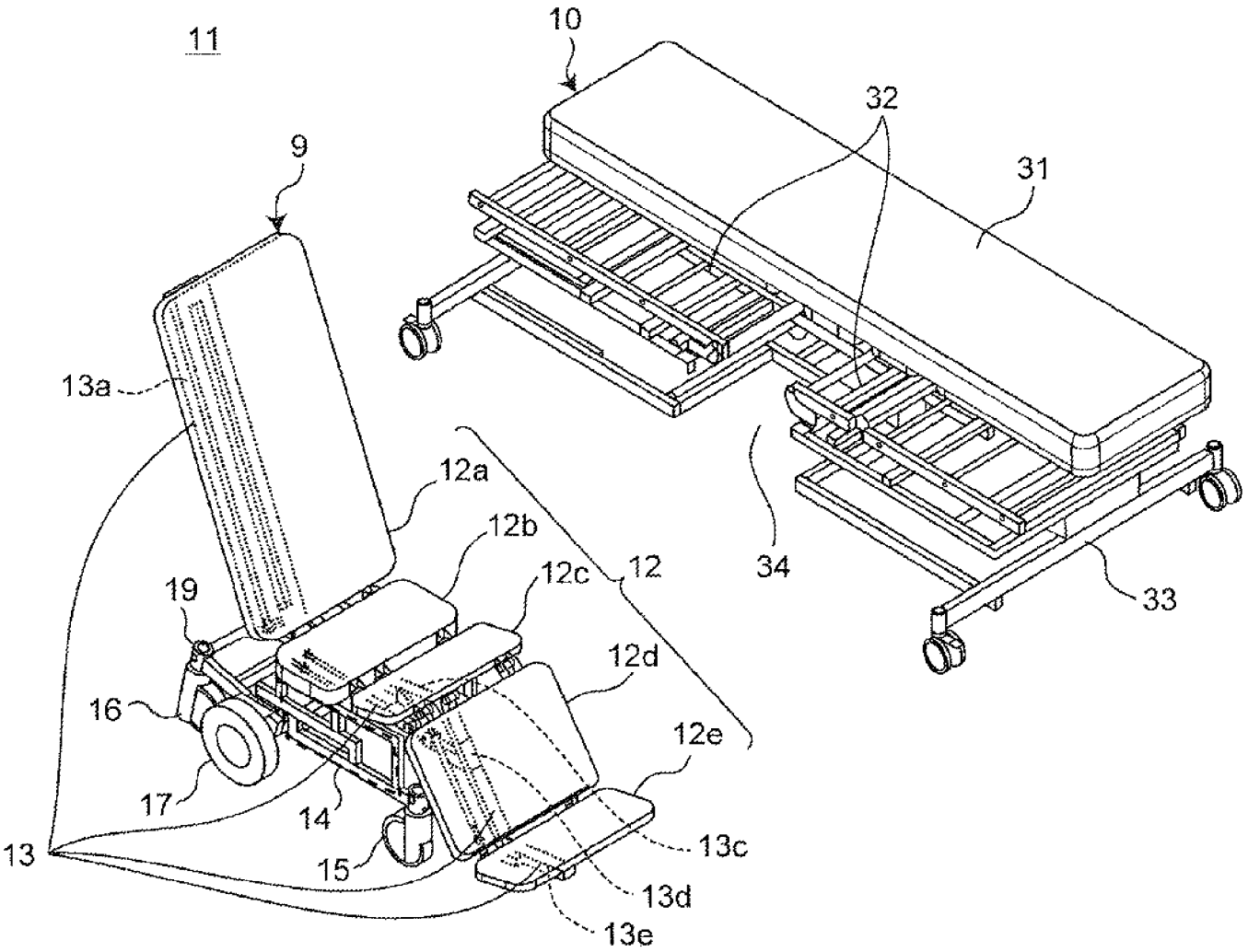
FIG. 1 is a perspective view of a separated combination bed in a first embodiment of the present invention.

Hereinafter, embodiments of the present invention will be described with reference to the drawings. It should be noted that the same constituent elements will be given the same reference numerals, and description thereof will sometimes be omitted. For easy understanding, the drawings are schematic and focus on the constituent elements.

First Embodiment

FIG. 1 is a perspective view of a separated bed 11 in a first embodiment of the present invention. The bed 11 includes a wheelchair 9 and a bed main body portion 10.

As shown in FIG. 1, the bed 11 is separated into the wheelchair 9 and the bed main body portion 10. The wheelchair 9 can be utilized as a single body wheelchair. In a case of a seating posture (a wheelchair state) as shown in FIG. 1, the wheelchair 9 cannot be omnidirectionally moved. However, by changing the seating posture to a flat posture, the wheelchair can be omnidirectionally moved including lateral movement.

The wheelchair 9 has a seating bottom portion 12 composed of bendably coupling a back bottom part, a seating bottom part, and a leg bottom part, and a chair bottom support member (chair guide portion) 13 supporting the seating bottom portion 12. The chair bottom support member 13 changes a posture of the leg bottom part in conjunction with inclination of the back bottom part, and a chair base portion 14 coupled to the chair bottom support member 13 fixes the chair bottom support member 13. Here, the back bottom part corresponds to a chair back bottom member 12*a* supported by a chair back bottom support member (chair back guide portion) 13*a* in FIGS. 2A to 2B. The seating bottom part corresponds to a chair waist bottom member 12*b* of FIGS. 2A to 2B. The leg bottom part corresponds to a chair knee bottom member 12*c* supported by a chair knee bottom support member (chair knee guide portion) 13*c* in FIGS. 2A to 2B, a chair leg first bottom member 12*d* supported by a chair leg first bottom support member (chair leg first guide portion) 13*d*, and a chair leg second bottom member 12*e* supported by a chair leg second bottom support member (chair leg second guide portion) 13*e*. That is, the seating bottom portion 12 is composed of the chair back bottom member 12*a*, the chair waist bottom member 12*b*, the chair knee bottom member 12*c*, the chair leg first bottom member 12*d*, and the chair leg second bottom member 12*e*. Among these members, the adjacent members are bendably coupled to each other via coupling parts of thin parts or hinge parts. The coupling parts of the thin parts are bendable by making the parts thinner than thickness of each of the bottom members composing the seating bottom portion 12, or the like. The chair back bottom member 12*a* is a part to be brought into contact with a back of a care-receiver. The chair waist bottom member 12*b* is a part to be brought into contact with a waist of the care-receiver. The chair knee bottom member 12*c* is a part to be brought into contact with thighs of the care-receiver. The chair leg first bottom member 12*d* is a part to be brought into contact with legs of the care-receiver. The chair leg second bottom member 12*e* is a part to be brought into contact with heels of the care-receiver. The chair back bottom member 12*a*, the chair waist bottom member 12*b*, the chair knee bottom member 12*c*, the chair leg first bottom member 12*d*, and the chair leg second bottom member 12*e* generally have a cushion function. The chair leg second bottom member 12*e* serves as a footrest when the wheelchair 9 is in the seating posture.

Further, the wheelchair 9 has front casters 15, side wheel bottom support members 19, traveling wheels 17, rear casters 16, and caster links (wheel links) 20.

The front casters 15 function as one example of a pair of front wheels provided in a front end of the chair base portion 14. Both side wheel bottom support members 19, serving as one example of wheel bottom support members, are axially supported on a rear part of the chair base portion 14. The rear casters 16 function as one example of a pair of rear wheels provided at ends (such as rear ends) of the both side wheel bottom support members 19. The pair of traveling wheels 17 is provided at the other ends (such as front ends) of the side wheel bottom support members 19. The caster links (the wheel links) 20 couple upper ends of the side wheel bottom support members 19 on the side of the rear casters 16 with a back bottom part of the chair bottom support member 13. Both the front casters 15 and the rear casters 16 are free casters (freewheels) whose traveling direction can be freely changed. The traveling wheels 17 are fixed casters (fixed wheels) whose traveling direction is fixed to the straight-moving direction.

Figure 2A:
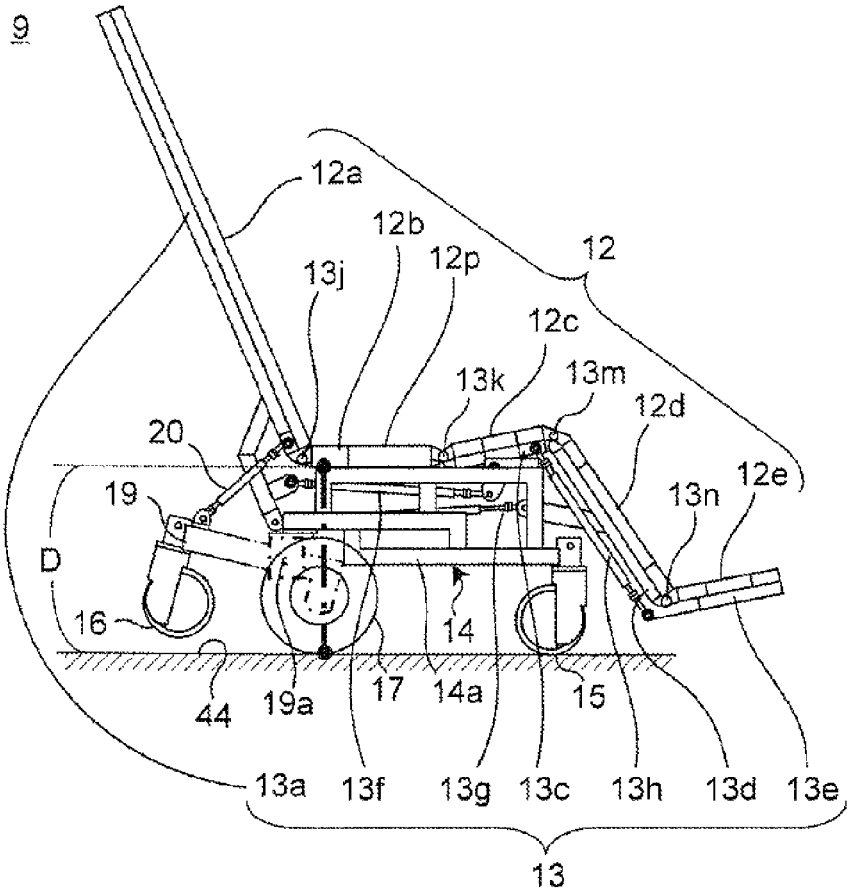
FIG. 2A is a side view of a wheelchair in a seating posture in the first embodiment.
Figure 2B:
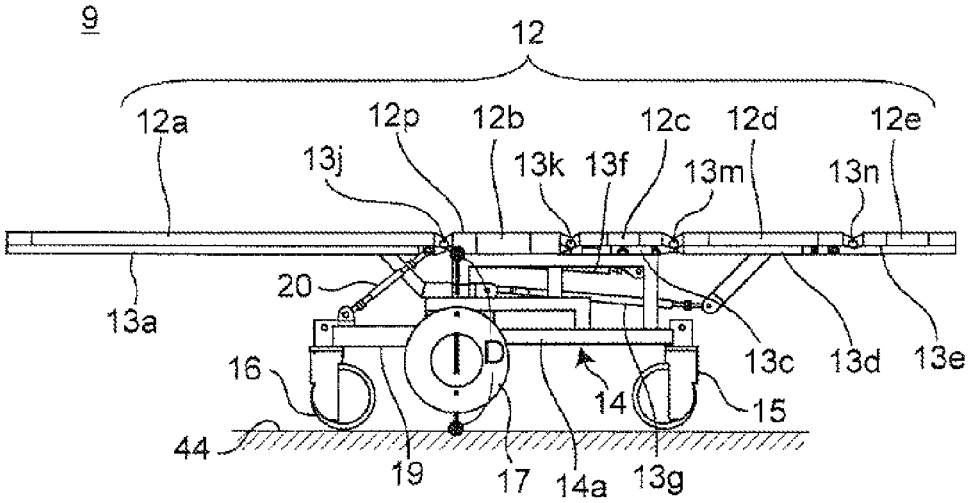
FIG. 2B is a side view of the wheelchair in a flat posture in the first embodiment.
Figure 2C:
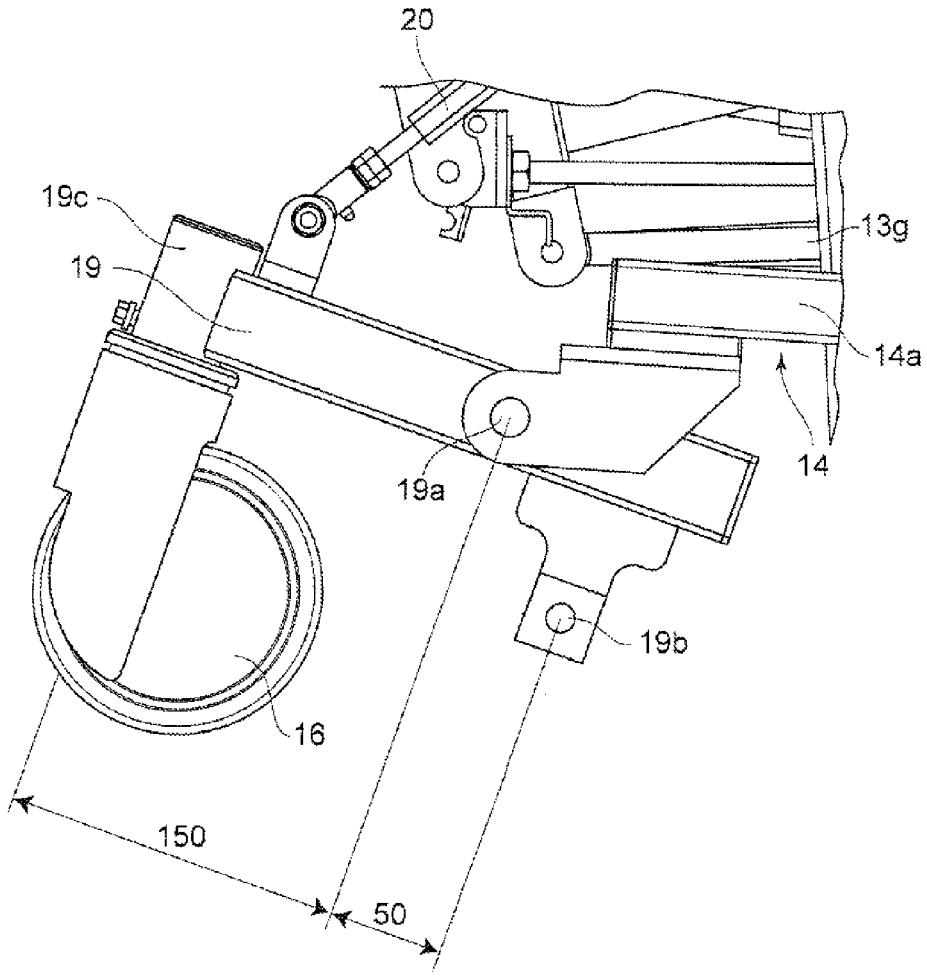
FIG. 2C is a partially enlarged side view of a wheel switching mechanism of the wheelchair in the first embodiment.

FIG. 2A is a side view of the wheelchair 9 in the seating posture (the wheelchair state), and FIG. 2B is a side view of the wheelchair 9 in the flat posture. FIG. 2C is a partially enlarged side view of a wheel switching mechanism. With FIGS. 2A to 2C, a posture change conjunction mechanism of the seating bottom portion of the wheelchair 9, and the wheel switching mechanism following the conjunction mechanism will be described.

Firstly, the posture change conjunction mechanism of the seating bottom portion will be described. The chair bottom support member 13 supporting the seating bottom portion 12 is composed of the chair back bottom support member 13*a* supporting the chair back bottom member 12*a*, the chair knee bottom support member 13*c* supporting the chair knee bottom member 12*c*, the chair leg first bottom support member 13*d* supporting the chair leg first bottom member 12*d*, the chair leg second bottom support member 13*e* supporting the chair leg second bottom member 12*e*, a first link portion 13*f*, a second link portion 13*g*, and a footrest conjunction link 13*h*. The seating bottom portion 12 is composed of at least the back bottom part 12*a*, the seating bottom part 12*b*, and the leg bottom part 12*c*, 12*d*, 12*e* so as to be bendable to each other. The chair bottom support member 13 is composed of at least the chair back bottom support member 13*a* supporting the back bottom part 12*a* and the chair leg bottom support member 13*d*, 13*e* supporting the leg bottom part 12*c*, 12*d*, 12*e*. Here, the chair leg first bottom support member 13*d* and the chair leg second bottom support member 13*e* compose the chair leg bottom support member. The first link portion 13*f*, the second link portion 13*g*, and the footrest conjunction link 13*h* compose a link member. The chair back bottom support member 13*a* and the chair knee bottom support member 13*c* are bendably coupled to the chair waist bottom member 12*b* via chair first and second bending portions 13*j*, 13*k*. The chair leg first bottom support member 13*d* is bendably coupled to the chair knee bottom support member 13*c* via a chair third bending portion 13*m*, and the chair leg second bottom support member 13*e* is bendably coupled to the chair leg first bottom support member 13*d* via a chair fourth bending portion 13*n*. The chair base portion 14 supports the chair waist bottom member 12*b* from the lower side.

Since the chair waist bottom member 12*b*, the chair back bottom support member 13*a*, and the chair knee bottom support member 13*c* are coupled to one another, position displacement is not generated between the chair bottom member 12 and the chair bottom support member 13.

The first link portion 13*f* couples the chair back bottom support member 13*a* and the chair knee bottom support member 13*c*. The first link portion 13*f* is a link for lifting the chair knee bottom support member 13*c* by lifting the chair back bottom support member 13*a*, and bringing down the chair knee bottom support member 13*c* by bringing down the chair back bottom support member 13*a*.

The second link portion 13*g* couples the chair back bottom support member 13*a* and the chair leg first bottom support member 13*d*. The second link portion 13*g* is a link for suspending down the chair leg first bottom support member 13*d* by lifting the chair back bottom support member 13*a*, and bringing up the suspended-down chair leg first bottom support member 13*d* by bringing down the chair back bottom support member 13*a*.

The footrest conjunction link 13*h* couples the chair knee bottom support member 13*c* and the chair leg second bottom support member 13*e* to one another. The footrest conjunction link 13*h* is a link for moving the chair knee bottom support member 13*c* and the chair leg second bottom support member 13*e* so as to make the chair knee bottom support member 13*c* and the chair leg second bottom support member 13*e* parallel.

With such a configuration, from the wheelchair 9 in the seating posture, when the chair back bottom member 12*a* is brought down until forming a horizontal surface, the chair back bottom support member 13*a* is also brought down until forming a horizontal surface. From the wheelchair 9 in the seating posture, the chair knee bottom support member 13*c*, the chair leg first bottom support member 13*d*, and the chair leg second bottom support member 13*e* serving as the leg bottom part of the chair bottom support member 13 interlock and form a horizontal surface in conjunction with movement of the chair back bottom support member 13*a* serving as the back bottom part of the chair bottom support member 13. As a result, the seating bottom portion 12 forms a horizontal surface, so that the wheelchair 9 is brought into the flat posture.

Next, the wheel switching mechanism in conjunction with posture change of the seating bottom portion will be described.

An intermediate part of the side wheel bottom support member 19 is rotatably axially supported on the rear part of the chair base portion 14 by a rotation shaft 19*a*. A traveling wheel attachment portion 19*b* is provided on the front side of the rotation shaft 19*a* of the side wheel bottom support member 19, so that the traveling wheel 17 is attached. A rear caster attachment portion 19*c* is provided on the rear side of the rotation shaft 19*a* of the side wheel bottom support member 19, so that the rear caster 16 is attached. A part of the side wheel bottom support member 19 in the vicinity of the rear caster attachment portion 19*c* and a part of the chair back bottom support member 13*a* in the vicinity of the chair first bending portion 13*j* are coupled by a rod shaped caster link 20 in such a manner that the side wheel bottom support member 19 is in conjunction with the movement of the chair back bottom support member 13*a*.

A characteristic of this wheel switching mechanism is that while the side wheel bottom support member 19 is forward and reverse pivoted relative to the chair base portion 14, a pivoting point of the side wheel bottom support member 19 is switched between a rotation shaft of the traveling wheel 17 and a rotation shaft of the rear caster 16.

That is, when the seating posture is changed to the flat posture, the side wheel bottom support member 19 is pivoted about the rotation shaft of the traveling wheel 17 until the rear caster 16 is grounded. Meanwhile after the rear caster 16 is grounded, the side wheel bottom support member 19 is pivoted about the rotation shaft of the rear caster 16, so that the traveling wheel 17 is brought up and the traveling wheel 17 is brought away from the ground. During this pivoting action, the side wheel bottom support member 19 is pivoted about a fulcrum part (the rotation shaft) 19*a* relative to the chair base portion 14.

Conversely, when the flat posture is changed to the seating posture, the both side wheel bottom support member 19 is pivoted about the rotation shaft of the rear caster 16 until the traveling wheel 17 is grounded. Meanwhile, after the traveling wheel 17 is grounded, the both side wheel bottom support member 19 is pivoted about the rotation shaft of the traveling wheel 17, so that the rear caster 16 is brought up. During this pivoting action, the side wheel bottom support member 19 is pivoted about the fulcrum part (the rotation shaft) 19*a* relative to the chair base portion 14.

Further description will be given below.

Suppose that the chair back bottom member 12*a* is lifted from the flat posture in FIG. 2B to the seating posture in FIG. 2A after the wheelchair 9 and the bed main body portion 10 are separated. At this time, by lifting from the flat posture to the seating posture, the chair back bottom support member 13*a* is pivoted clockwise in FIG. 2B about the chair first bending portion 13*j*. By this pivoting action, at the beginning, a rear part of the side wheel bottom support member 19 allows the rear caster 16 to be supported on the ground (or an installment surface of the wheelchair 9 and the bed main body portion 10) 44 by the caster link 20. After that, the side wheel bottom support member 19 is pivoted about the rotation shaft of the rear caster 16, so that the fulcrum part (the rotation shaft) 19*a* is lowered relative to the chair base portion 14. Since the fulcrum part (the rotation shaft) 19*a* is lowered, the traveling wheel 17 is supported on the ground 44. After that, since the side wheel bottom support member 19 is pulled by the caster link 20, the side wheel bottom support member 19 is pivoted clockwise about the fulcrum part (the rotation shaft) 19*a* relative to the chair base portion 14. As a result of this pivoting, the rear caster 16 is brought up and floated up from the ground 44. Further, since the chair back bottom support member 13*a* performs a pivoting action to the seating posture, the both side wheel bottom support member 19 pulled by the caster link 20 is pivoted about the rotation shaft of the grounded traveling wheel 17 and brought up, so as to bring up the fulcrum part (the rotation shaft) 19*a* relative to the ground 44. As a result, when the flat posture is changed to the seating posture, a rear seating height of the chair waist bottom member 12*b* (seating height on the side of the chair back bottom member 12*a*) is firstly lowered and then brought up again in comparison to a front seating height (seating height on the side of the chair knee bottom member 12*c*). When the wheelchair 9 is changed to the seating posture in the end, the chair waist bottom member 12*b* is at the same height as the flat posture.

That is, in the wheelchair 9 in the seating posture, as shown in FIG. 2A, lower surfaces of the traveling wheels 17 are positioned on the lower side (on the side of the ground 44) of a plane composed of lower surfaces (surfaces on the side of the ground 44) of the two front casters 15 and lower surfaces (surfaces on the side of the ground 44) of the two rear casters 16. Therefore, in the wheelchair 9 in the seating posture, the front casters 15 and the traveling wheels 17 are grounded.

Meanwhile, in the wheelchair 9 in the flat posture, as shown in FIG. 2B, the lower surfaces of the traveling wheels 17 are positioned on the upper side (on the side of the wheelchair 9 relative to the ground 44) of the plane composed of the lower surfaces of the two front casters 15 and the lower surfaces of the two rear casters 16. Therefore, in the wheelchair 9 in the flat posture, the front casters 15 and the rear casters 16 are grounded.

In such a way, in the case where the wheelchair is changed to the seating posture and the traveling wheels 17 are brought into contact with the ground 44 instead of the rear casters 16, wheels supporting the wheelchair 9 are a combination of the traveling wheels 17 serving as the fixed wheels and the front casters 15 serving as the freewheels. Therefore, when the wheelchair 9 in the seating posture is moved, the wheelchair 9 can stably travel without shifting in the left and right directions.

When the chair back bottom member 12*a* is brought down from the seating posture in FIG. 2A to the flat posture in FIG. 2B for preparation for combining the wheelchair 9 and the bed main body portion 10, the chair back bottom member 12*a* is pivoted anticlockwise in FIG. 2A about the chair first bending portion 13*j*. By this pivoting action, the rear parts of the side wheel bottom support members 19 are pushed by the caster links 20. As a result, firstly, the fulcrum parts (the rotation shafts) 19*a* are lowered by pivoting the both side wheel bottom support members 19 about the rotation shafts of the traveling wheels 17, and the side wheel bottom support members 19 are pivoted about the fulcrum parts (the rotation shafts) 19*a* relative to the chair base portion 14. After the rear casters 16 are pushed down by this pivoting of the both side wheel bottom support members 19 and the rear casters 16 are brought into contact with the ground 44, by further pivoting the both side wheel bottom support members 19 about the rotation shaft of the rear casters 16, the traveling wheels 17 are brought up and floated up from the ground 44, so that the traveling wheels 17 are brought away from the ground. As a result, when the seating posture is changed to the flat posture, the rear seating height of the chair waist bottom member 12*b* is not particularly changed in comparison to the front seating height and remains along a horizontal surface. In such a way, in the case where the rear casters 16 are brought into contact with the ground 44 instead of the traveling wheels 17, the wheels supporting the wheelchair 9 in the flat posture are the front casters 15 and the rear casters 16. At this time, the wheelchair 9 in the flat posture is a combination of the front casters 15 serving as the freewheels and the rear casters 16 serving as the freewheels, so that the wheelchair 9 can be omnidirectionally moved. By laterally moving the wheelchair 9, the wheelchair 9 changed to the flat posture and the bed main body portion 10 can be closely attached and coupled to each other.

In the case where the seating posture is changed to the flat posture, in a process of switching the rear casters 16 and the traveling wheels 17, firstly, in FIG. 2A, in a state where the traveling wheels 17 are on the ground 44, the both side wheel bottom support members 19 are pushed downward by the caster links 20, and the both side wheel bottom support members 19 are pivoted anticlockwise about the rotation shafts of the traveling wheels 17, so that the fulcrum parts (the rotation shafts) 19*a* of the chair base portion 14 are lowered. As a result, until the rear casters 16 are supported on the ground 44, the rear seating height D of the chair waist bottom member 12*b* is lower than the rear seating height D of the chair waist bottom member 12*b* at the time of the seating posture. Then, after the rear casters 16 are grounded, the rear casters 16 are pushed downward by the caster links 20, the side wheel bottom support members 19 are pivoted anticlockwise about the rotation shafts of the rear casters 16, and the fulcrum parts (the rotation shafts) 19*a* are brought up relative to the ground 44, so that the traveling wheels 17 are brought away from the ground. As a result, as shown as the flat posture in FIG. 2B, the lowered rear seating height D is brought up again to the rear seating height D of the chair waist bottom member 12*b* at the time of the seating posture.

Here, by adjusting lengths from the fulcrum part 19*a* to the traveling wheel 17 and to the rear caster 16 in such a manner that the height of the rear seating height D is the same between the seating posture and the flat posture, the chair waist bottom member 12*b* can be a horizontal surface without inclining forward. In order to perform this adjustment, for example, the "length from the fulcrum part 19*a* to the traveling wheel 17": the "length from the fulcrum part 19*a* to the rear caster 16" may be equal to 50 mm:150 mm, that is, 1:3.

With the above configuration, in both states where the seating bottom portion 12 is in the seating posture and in the flat posture, an arrangement surface 12*p* along a horizontal surface of the chair waist bottom member 12*b* of the seating bottom portion 12 is parallel to a support frame 14*a* of the chair base portion 14 supporting the front casters 15 and the rotation shafts 19*a* serving as axially supporting parts of the both side wheel bottom support members 19. As a result, in both the states of the seating posture and the flat posture, the care-receiver can be stably supported by the seating bottom portion 12, so that the care-receiver can reliably accept the posture change.

The front casters 15 are always grounded. While the front seating height of the chair waist bottom member 12*b* is a fixed height, the chair waist bottom member 12*b* becomes inclined rearward when the rear seating height D of the chair waist bottom member 12*b* is lowered relative to the front seating height. However, the care-receiver seated on the wheelchair 9 is supported by the chair back bottom member 12*a*. Thus, even upon rearward inclination, the care-receiver does not slip downward from the wheelchair 9. Since the wheels are switched by the caster links 20 in conjunction with the posture change, the combination takes less time and effort.

Since a position of the wheels to be grounded is changed between a case of the seating posture and a case of the flat posture in the wheelchair 9 (that is, since the position of the wheels is changed from a position on the lower side of the chair first bending portion 13*j* serving as a position of the traveling wheels 17 to a position on the lower side of the chair back bottom support member 13*a* serving as a position of the rear casters 16), the seating bottom portion 12 can be stably supported. Hereinafter, reasons thereof will be described.

In a case of the seating posture, most of weight of the care-receiver is applied to the chair waist bottom member 12*b*. However, in the flat posture, about a half of the weight of the care-receiver is applied to the chair back bottom member 12*a*. Therefore, in a case of the flat posture, when the grounded wheels are the traveling wheels 17 and the front casters 15, the traveling wheels 17 serve as a fulcrum, and ends on the front end side of the chair back bottom member 12*a* (on the opposite side of the chair waist bottom member 12*b*) may be sometimes inclined downward.

In a case where the seating bottom portion 12 is in the flat posture, as shown in FIG. 2B, the rear casters 16 are grounded on the lower side of the chair back bottom support member 13*a* (at a position on the front end side of the chair back bottom support member 13*a* rather than the chair first bending portion 13*j*). Thus, the seating bottom portion 12 in the flat posture can be stably supported.

Since the grounded rear casters 16 are grounded on the lower side of the chair back bottom support member 13*a*, the rear casters 16 stably support the wheelchair 9 in the flat posture.

Thereby, in the first embodiment, in the seating posture (the wheelchair state), the traveling wheels 17 are always arranged at positions closer to the front casters 15. Therefore, a turning radius of the wheelchair 9 in the seating posture is not increased, and as a result, an operability of the wheelchair 9 for example, in a narrow interior space, is not deteriorated.

Further, in the flat posture, the rear casters 16 are always grounded on the lower side of the chair back bottom support member 13*a*. Therefore, the gravity center balance at the time of lateral movement of the wheelchair 9 in the flat posture is stabilized, and turning of the wheelchair 9 in the flat posture is also stabilized.

Figure 3:
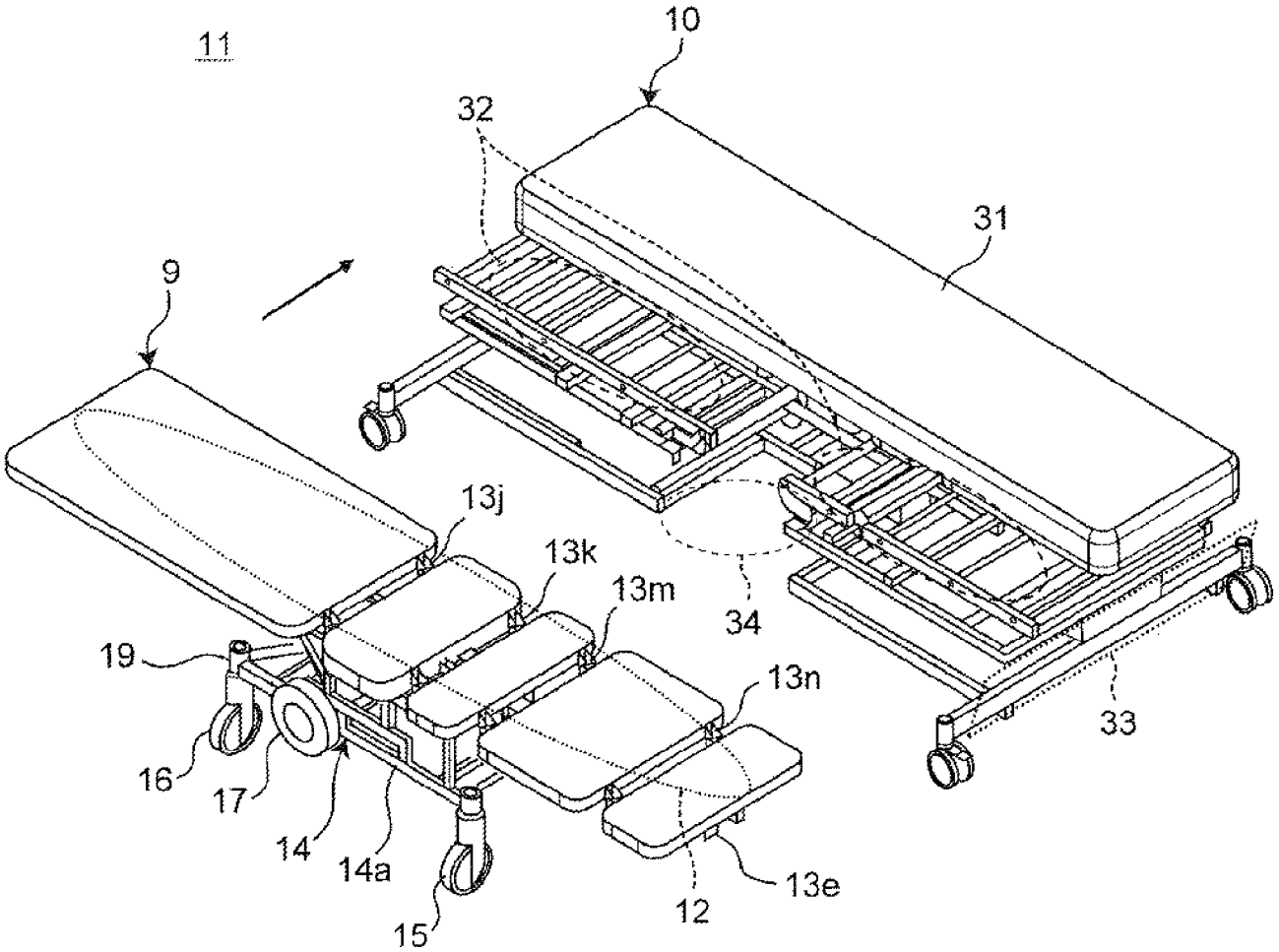
FIG. 3 is a perspective view of the combination bed prepared to be combined in the first embodiment.

FIG. 3 is a perspective view of the bed 11 in a combination preparation state. Next, with FIG. 3, the combination of the wheelchair 9 in the flat posture and the bed main body portion 10 will be described.

The bed main body portion 10 is composed of a bed bottom portion 31, a bed surface bottom support member 32 supporting the bed bottom portion 31, and a bed base portion 33 supporting the bed surface bottom support member 32. In the bed surface bottom support member 32, in the case where the wheelchair 9 and the bed main body portion 10 are combined, a protruding part (an exposed part in FIG. 3) of the bed surface bottom support member 32 is brought into contact with the seating bottom portion 12 so as to support not only the bed bottom portion 31 but also the seating bottom portion 12.

The bed main body portion 10 has a recess portion 34 serving as a combination area for arranging the chair base portion 14 of the wheelchair 9.

Firstly, in order to combine with the bed main body portion 10, the wheelchair 9 changed to the flat posture is arranged alongside the bed main body portion 10. Since the wheelchair 9 in the flat posture can be laterally moved, the wheelchair 9 can be closely attached to and combined with the bed main body portion 10. The seating bottom portion 12 and the bed bottom portion 31 combined in such a way can compose a bed surface without any gap between the seating bottom portion 12 and the bed bottom portion 31.

When the recess portion 34 serving as the combination area for arranging the chair base portion 14 is positioned in a recessed part of the bed surface bottom support member 32 and the bed main body portion 10, the combination is only performed from an arrow direction in FIG. 3. By using the wheelchair 9 of the first embodiment, the wheelchair 9 can be stably combined even with the bed main body portion 10 having such a configuration.

Figure 4:
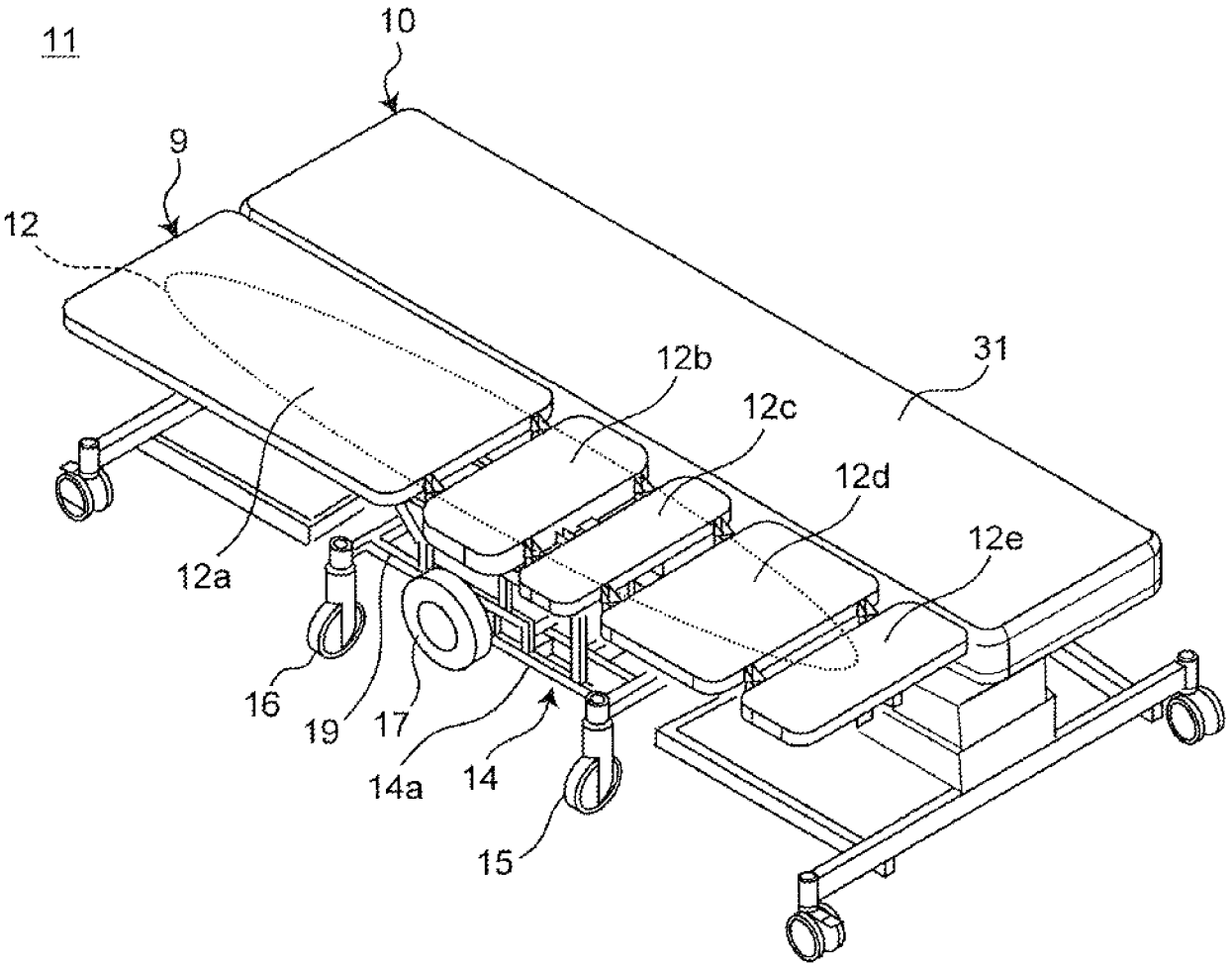
FIG. 4 is a perspective view of the combined combination bed in the first embodiment.

FIG. 4 is a perspective view of the combined bed 11. The bed 11 is composed of closely attaching the bed main body portion 10 and the wheelchair 9. Since the seating bottom portion 12 and the bed bottom portion 31 are closely attached, the care-receiver can utilize the bed 11 as a general bed without any discomfort.

In a state of the bed 11, the chair bottom support member 13 supports the seating bottom portion 12 but does not fix these. That is, in a state of the bed 11, the chair bottom support member 13 and the seating bottom portion 12 can be separated. Therefore, when the bed surface bottom support member 32 performs the posture change after the bed main body portion 10 and the wheelchair 9 are combined, the seating bottom portion 12 performs the posture change in accordance with this posture change of the bed surface bottom support member 32.

Furthermore, the wheelchair 9 of the first embodiment is also useful in the case where the care-receiver seated on the wheelchair 9 is transferred to a bed except for utilizing the wheelchair as one member composing the bed 11. In the wheelchair 9 of the first embodiment, the wheelchair 9 can be easily changed from the seating posture to the flat posture, laterally moved, and laterally placed alongside the bed. When the height of the bed is matched with the height of the wheelchair 9 in the flat posture, the care-receiver can be transferred from the wheelchair 9 to the bed without any burden.

In a state where the wheelchair 9 is in the seating posture, the brought-up rear casters 16 also play a role of preventing rollover of the wheelchair 9. When a caregiver pushes the wheelchair 9 in the seating posture so as to go over a level difference or the like, the front casters 15 firstly go upon the level difference, so that the wheelchair 9 is inclined rearward. At the time, there is a possibility that the caregiver cannot support the weight of the care-receiver and the wheelchair 9, and hence the wheelchair 9 may roll over. However, in the wheelchair 9 of the first embodiment, even in such a case, the rear casters 16 are grounded before the rollover. That is, the wheelchair 9 of the first embodiment prevents the rollover by utilizing the rear casters 16 serving as the wheels at the time of the flat posture as a rollover preventing mechanism at the time of the seating posture.

Second Embodiment

Figure 5:
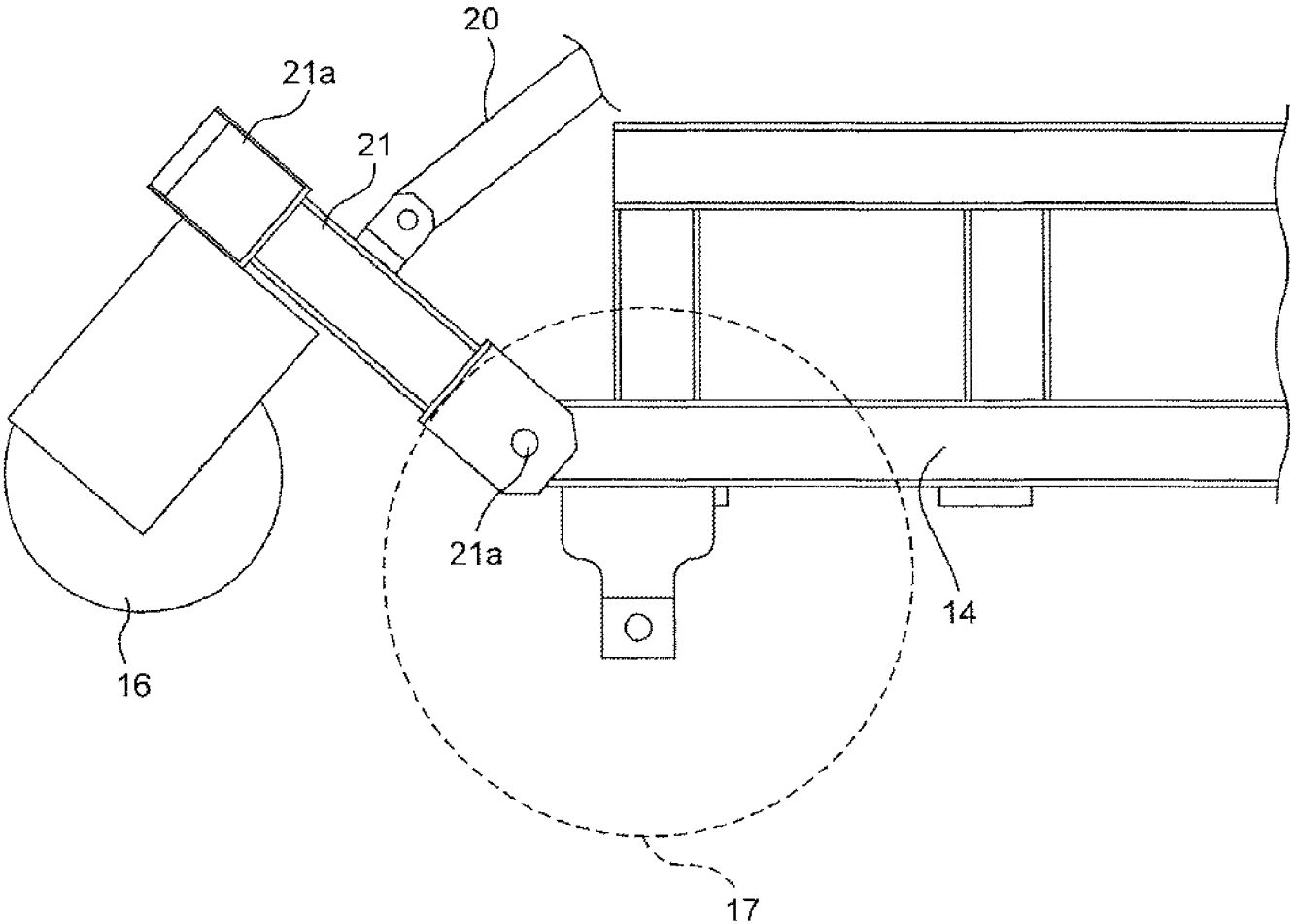
FIG. 5 is a partially enlarged view of a wheel switching mechanism of the wheelchair in a second embodiment of the present invention.
Figure 6A:
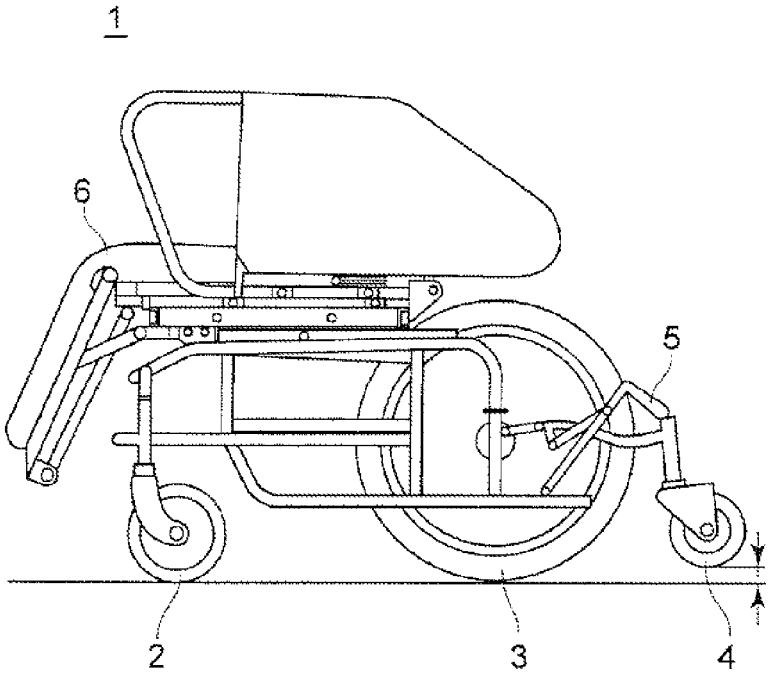
FIG. 6A is a side view of a conventional wheelchair at the time of normal use.
Figure 6B:
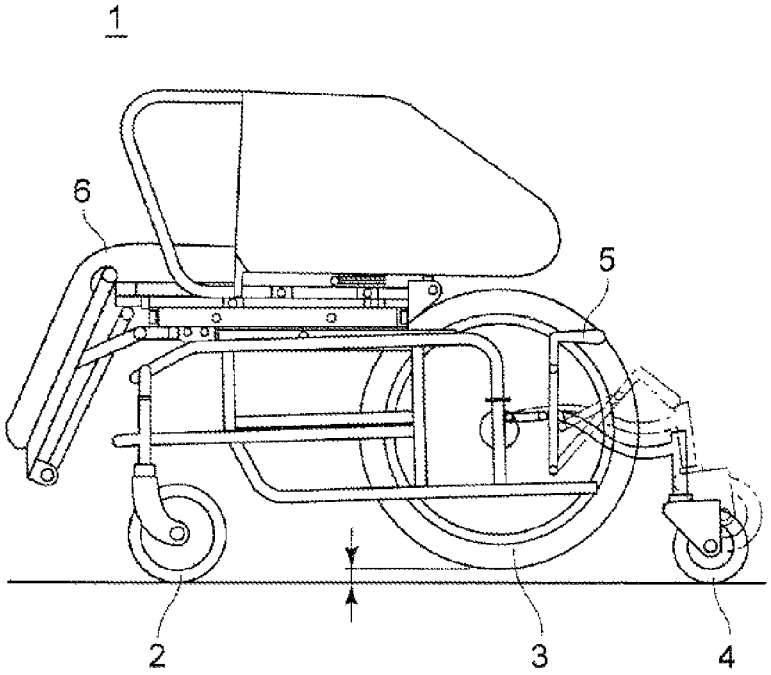
FIG. 6B is a side view of the conventional wheelchair at the time of omnidirectional movement.

FIG. 5 is a partially enlarged view of a wheel switching mechanism of a second embodiment. The second embodiment is the same as the above first embodiment except for the wheel switching mechanism. Therefore, in the second embodiment, only the wheel switching mechanism will be described.

In FIG. 5, the traveling wheel 17 is rotatably fixed to the rear part of the chair base portion 14. An end of a rear caster bottom support member 21 supporting the rear caster 16 is pivotably fixed to a rear end of the chair base portion 14 so as to be pivoted about a pivot shaft 21*a*. The caster link 20 is respectively fixed close to the vicinity of the rear caster 16 and the rotation shaft of the chair back bottom support member 13*a*. The rear caster bottom support member 21 is one example of a rear wheel bottom support member.

Hereinafter, an action of the wheel switching mechanism of the second embodiment will be described.

When the chair back bottom support member 13*a* and the chair back bottom member 12*a* are in a flat state, the rear casters 16 are grounded so as to be omnidirectionally moved. At this time, the chair waist bottom member 12*b* is horizontal.

When the chair back bottom support member 13*a* is brought up into the seating posture (the wheelchair state), the rear caster bottom support members 21 are pivoted about the pivot shafts 21*a* by the caster links 20. At this time, until the traveling wheels 17 are grounded, the chair base portion 14 is inclined rearward as the chair back bottom support member 13*a* is lifted. After the traveling wheels 17 are grounded, inclination of the chair base portion 14 is maintained to be inclination at the time point when the traveling wheels 17 are grounded, and the rear casters 16 are lifted as the chair back bottom support member 13*a* is lifted. Therefore, when the chair back bottom support member 13*a* is in the seating posture (the wheelchair state), the traveling wheels 17 and the front casters 15 are grounded.

When the chair back bottom support member 13*a* is changed from the seating posture to the flat posture, the rear caster bottom support members 21 are pivoted about the pivot shafts 21*a* as the chair back bottom support member 13*a* is lowered, and the rear caster bottom support members 21 are lowered until the rear casters 16 are grounded. When the rear casters 16 are grounded, the traveling wheels 17 are brought up, and the chair base portion 14 comes close to being horizontal as the chair back bottom support member 13*a* is lowered. When the chair back bottom support member 13*a* becomes horizontal, the chair base portion 14 also becomes horizontal.

By the above action, the wheelchair 9 in the second embodiment is inclined slightly rearward in the seating posture. Thus, a possibility of downward slippage of the care-receiver from the wheelchair 9 can be reduced, and the same flat state as the bed can be maintained in the flat posture.

By appropriately combining arbitrary embodiments or modification examples among the above various embodiments or modification examples, effects provided in the embodiments and the modification examples can be obtained.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

By using the wheelchair of the present invention and the wheelchair to be combined with the bed as a part of the bed, an operation for combining the wheelchair with the bed main body portion can be easily performed, and the wheels can be switched with less time and effort. Such a wheelchair is useful in an ordinary house, a hospital facility, and a nursing care facility where a person in need of care resides.

The invention claimed is:

1. A bed comprising a wheelchair and a bed main body portion with which the wheelchair is separably combinable to form the bed, the wheelchair comprising:

a seating bottom portion composed of a back bottom part, a seating bottom part and a leg bottom part which are bendable with respect to each other;

a chair bottom support member composed of a chair back bottom support member supporting said back bottom part and a chair leg bottom support member supporting said leg bottom part;

a link member configured to actuate said chair leg bottom support member in conjunction with said chair back bottom support member;

a chair base portion coupled to said chair bottom support member;

front wheels which are freewheels provided at a front part of said chair base portion;

wheel bottom support members which have intermediate parts that are pivotally supported on a rear part of said chair base portion;

rear wheels which are freewheels provided at first ends of said wheel bottom support members;

traveling wheels which are fixed wheels provided at second ends of said wheel bottom support members; and wheel links coupling rear wheel sides of said wheel bottom support members and said chair back bottom support member;

wherein, in a wheelchair state in which said chair back bottom support member is in a raised position and said seating bottom portion is in a seating posture, lower surfaces of said traveling wheels are positioned on a lower side of a plane including lower surfaces of said rear wheels and lower surfaces of said front wheels; and wherein, in a state in which said chair back bottom support member is lowered and said seating bottom portion is in a flat posture and is horizontal, the lower surfaces of said traveling wheels are positioned on an upper side of the plane including the lower surfaces of said rear wheels and the lower surfaces of said front wheels and said wheel bottom support members and the chair base portion are horizontal.

2. The bed of claim 1, wherein said wheelchair is configured such that:

in a case in which said seating bottom portion is moved into the seating posture, said rear wheels are pulled up by said wheel links and said chair back bottom support member and said front wheels and said traveling wheels are grounded, and in a case in which said seating bottom portion is moved into the flat posture, said rear wheels are pushed down by said wheel links and said chair back bottom support member, the traveling wheels are in a raised position, and said front wheels and said rear wheels are grounded.

3. The bed of claim 1, wherein said wheelchair is configured such that said first ends of said wheel bottom support members at which said rear wheels are provided are rear ends of said wheel bottom support members, and said second ends of said wheel bottom support members at which said traveling wheels are provided are front ends of said wheel bottom support members.

4. The bed of claim 1, wherein said traveling wheels are fixed casters whose moving direction is fixed to be one direction relative to said wheelchair.

5. The bed of claim 1, wherein said wheelchair has an arrangement surface of said seating bottom part of said seating bottom portion which, in both the state of said seating bottom portion being in a seating posture and the state of said seating bottom portion being in a flat posture, is parallel to a support frame that supports said front wheels and pivotally supports parts of said wheel bottom support members.

6. The bed of claim 1, wherein said bed main body portion has a recess portion in which said chair base portion is arranged.

7. A bed comprising a wheelchair and a bed main body portion with which the wheelchair is separably combinable to form the bed, the wheelchair comprising:

a seating bottom portion composed of a back bottom part, a seating bottom part and a leg bottom part which are bendable with respect to each other;

a chair bottom support member composed of a chair back bottom support member supporting said back bottom part and a chair leg bottom support member supporting said leg bottom part;

a link member configured to actuate said chair leg bottom support member in conjunction with said chair back bottom support member;

a chair base portion coupled to said chair bottom support member;

front wheels which are freewheels provided at a front part of said chair base portion;

rear wheel bottom support members which have ends that are pivotally supported on a rear part of said chair base portion;

rear wheels which are freewheels provided at one end of said wheel bottom support members;

traveling wheels which are fixed wheels provided at a rear side of said chair base portion; and wheel links coupling rear wheel sides of said rear wheel bottom support members and the back bottom part of said chair back bottom support member;

wherein, in a wheelchair state in which said chair back bottom support member is in a raised position and said seating bottom portion is in a seating posture, lower surfaces of said traveling wheels are positioned on a lower side of a plane including lower surfaces of said rear wheels and lower surfaces of said front wheels; and wherein, in a state in which said chair back bottom support member is lowered and said seating bottom portion is in a flat posture and is horizontal, the lower surfaces of said traveling wheels are positioned on an upper side of the plane including the lower surfaces of said rear wheels and the lower surfaces of said front wheels and said rear wheel bottom support members and the chair base portion are horizontal.

8. The bed of claim 7, wherein said wheelchair is configured such that said first ends of said wheel bottom support members at which said rear wheels are provided are rear ends of said wheel bottom support members, and said second ends of said wheel bottom support members at which said traveling wheels are provided are front ends of said wheel bottom support members.

9. The bed of claim 7, wherein said traveling wheels are fixed casters whose moving direction is fixed to be one direction relative to said wheelchair.

10. The bed of claim 7, wherein said bed main body portion has a recess portion in which said chair base portion is arranged.

* * * * *